US007929881B2

(12) United States Patent
Yoshino et al.

(10) Patent No.: US 7,929,881 B2
(45) Date of Patent: Apr. 19, 2011

(54) PROCESS CARTRIDGE AND ELECTROPHOTOGRAPHIC IMAGE FORMING APPARATUS

(75) Inventors: Yasufumi Yoshino, Numazu (JP); Kazuhiko Kanno, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 287 days.

(21) Appl. No.: 11/944,817

(22) Filed: Nov. 26, 2007

(65) Prior Publication Data

US 2008/0138110 A1 Jun. 12, 2008

(30) Foreign Application Priority Data

Dec. 11, 2006 (JP) ..... 2006-333859
Nov. 13, 2007 (JP) ..... 2007-294950

(51) Int. Cl.
*G03G 15/00* (2006.01)

(52) U.S. Cl. ..... 399/113; 399/114

(58) Field of Classification Search ..... 399/111, 399/113, 114
See application file for complete search history.

(56) References Cited

U.S. PATENT DOCUMENTS

| | | | | |
|---|---|---|---|---|
| 5,729,796 | A | 3/1998 | Miura et al. | 399/114 |
| 5,815,644 | A | 9/1998 | Nishiuwatoko et al. | 399/113 |
| 5,870,655 | A | 2/1999 | Nishiuwatoko et al. | 399/111 |
| 5,893,006 | A | 4/1999 | Kanno et al. | 399/13 |
| 5,926,666 | A | 7/1999 | Miura et al. | 399/25 |
| 5,937,240 | A | 8/1999 | Kanno et al. | 399/111 |
| 5,940,657 | A | 8/1999 | Yokomori et al. | 399/119 |
| 5,950,049 | A | 9/1999 | Yokomori et al. | 399/119 |
| 6,072,969 | A | 6/2000 | Yokomori et al. | 399/119 |
| 6,345,164 | B1 | 2/2002 | Yokomori et al. | 399/119 |
| 6,381,430 | B1 | 4/2002 | Yokomori et al. | 399/119 |
| 6,496,667 | B2 | 12/2002 | Shiratori et al. | 399/103 |
| 6,516,168 | B2 | 2/2003 | Shiratori et al. | 399/103 |
| 6,560,422 | B2 | 5/2003 | Kanno et al. | 399/106 |
| 6,681,088 | B2 | 1/2004 | Kanno et al. | 399/111 |
| 6,735,403 | B2 | 5/2004 | Kanno et al. | 399/103 |
| 6,782,219 | B2 | 8/2004 | Yoshino et al. | 399/90 |
| 6,834,173 | B2 | 12/2004 | Yamaguchi et al. | 399/119 |
| 6,915,092 | B2 | 7/2005 | Yamaguchi et al. | 399/109 |
| 6,937,834 | B2 | 8/2005 | Kanno et al. | 399/114 |
| 6,947,687 | B2 | 9/2005 | Yamaguchi et al. | 399/111 |
| 6,961,528 | B2 | 11/2005 | Yamaguchi et al. | 399/119 |
| 6,978,100 | B2 | 12/2005 | Yasui et al. | 399/103 |

(Continued)

FOREIGN PATENT DOCUMENTS

JP 8-292706 11/1996

(Continued)

*Primary Examiner* — David P Porta
*Assistant Examiner* — David S Baker
(74) *Attorney, Agent, or Firm* — Fitzpatrick, Cella, Harper & Scinto

(57) ABSTRACT

A process cartridge includes a photosensitive drum, a photosensitive unit rotatably supporting the drum, and a protecting cover mountable to an electrophotographic image forming apparatus main body, for protecting the drum exposed to the outside of the photosensitive unit. The protecting cover includes a guide for guiding the cartridge to an inside of the main body along a longitudinal direction of the drum, a positioned portion at a leading end of the cover so as to be abutted against a positioning portion of the main body, for positioning the cover in a direction crossing the longitudinal direction, and an engaged portion at the leading end so as to be engaged with an engaging portion of the main body in the inserting direction, for regulating detachment of the protecting cover from the apparatus main body from an upstream side thereof in the insertion direction.

12 Claims, 17 Drawing Sheets

U.S. PATENT DOCUMENTS

| | | | | |
|---|---|---|---|---|
| 6,980,759 | B2 | 12/2005 | Kanno et al. | 399/111 |
| 6,983,115 | B2 | 1/2006 | Isobe et al. | 399/119 |
| 7,058,337 | B2 | 6/2006 | Hashimoto et al. | 399/111 |
| 7,068,965 | B2 | 6/2006 | Yoshino et al. | 399/119 |
| 7,155,137 | B2 | 12/2006 | Yasui et al. | 399/103 |
| 7,184,686 | B2 | 2/2007 | Kanno et al. | 399/111 |
| 7,676,174 | B2 * | 3/2010 | Okabe | 399/112 |
| 2004/0101328 | A1 * | 5/2004 | Kimura et al. | 399/111 |
| 2005/0025522 | A1 * | 2/2005 | Tsuzuki et al. | 399/111 |
| 2007/0071495 | A1 | 3/2007 | Hashimoto et al. | 399/111 |
| 2007/0206971 | A1 | 9/2007 | Yoshino | 399/111 |

FOREIGN PATENT DOCUMENTS

| | | | |
|---|---|---|---|
| JP | 08292706 | A * | 11/1996 |
| JP | 3535604 | | 3/2004 |

* cited by examiner

PROCESS CARTRIDGE AND ELECTROPHOTOGRAPHIC IMAGE FORMING APPARATUS

BACKGROUND OF THE INVENTION

1. Field of the Invention

The present invention relates to a process cartridge and an electrophotographic image forming apparatus to which a process cartridge is to be mounted, for forming an image.

In this case, the electrophotographic image forming apparatus is an apparatus for forming an image on a recording medium by using an electrophotographic image forming process. Examples of the electrophotographic image forming apparatus include an electrophotographic copying machine, an electrophotographic printer (for example, a laser beam printer and an LED printer), a facsimile apparatus, and a word processor.

Further, the process cartridge has a construction in which a charging device, a developing device, or a cleaning device, which serves as a process unit, and a photosensitive drum, are integrally formed into a cartridge, and the cartridge is structured to be detachably mountable to an electrophotographic image forming apparatus main body. In addition, the process cartridge has a structure in which at least one of the charging device, the developing device, and the cleaning device, and the photosensitive drum are integrally formed into a cartridge so as to be detachably mountable to the electrophotographic image forming apparatus main body. Further, the process cartridge has a structure in which at least the developing device and the photosensitive drum are integrally formed into a cartridge so as to be detachably mountable to the electrophotographic image forming apparatus main body.

2. Description of the Related Art

Conventionally, in an electrophotographic image forming apparatus, there has been employed a process cartridge system in which a photosensitive drum and a process unit acting on the photosensitive drum are integrally formed into a cartridge, and the cartridge is structured to be detachably mountable to an electrophotographic image forming apparatus main body. According to the process cartridge system, maintenance of the apparatus can be performed by a user himself/herself without depending on a service person, thereby drastically improving operability of the apparatus. Accordingly, the process cartridge system is widely used in a field of the electrophotographic image forming apparatus.

In the electrophotographic image forming apparatus, light such as a laser beam, light from an LED, or light from a lamp corresponding to image information is applied onto the photosensitive drum. As a result, an electrostatic latent image is formed on the photosensitive drum. Then, the electrostatic latent image is developed by a developing apparatus. Further, a developer image formed on the photosensitive drum is transferred onto a recording medium. Thus, an image is formed on the recording medium.

In the above-mentioned process, it is necessary for the process cartridge to be exposed to the outside at a position thereof where the photosensitive drum is opposed to the recording medium when the process cartridge is mounted to the electrophotographic image forming apparatus main body, and at a portion thereof opposing the process unit provided on a side of the apparatus main body, which acts on the photosensitive drum.

In view of the above, the process cartridge is provided with a protecting cover detachably attachable to the process cartridge so as not to damage a surface of the photosensitive drum at the time of insertion or distribution of the process cartridge. At the time of using the process cartridge, the process cartridge is mounted to the electrophotographic image forming apparatus main body in a state where the protecting cover is detached.

For example, Japanese Patent No. 3,535,604 (which was granted to Japanese Patent Application Laid-open No. H08-292706) discloses a method of inserting the process cartridge by using the protecting cover. In the method, the protecting cover detachable in a longitudinal direction is provided, and a convex portion formed on a lower portion of a leading end of the protecting cover in an insertion direction is fitted into a concave portion of the electrophotographic image forming apparatus main body, to position the protecting cover, thereby guiding the process cartridge to be mounted to the apparatus main body.

In the present invention, the above-mentioned structure is further developed.

In the construction of the related art, the positioning of the process cartridge is performed merely by fitting the convex portion of the protecting cover into the concave portion of the electrophotographic image forming apparatus main body. Accordingly, when the process cartridge is mounted to the apparatus main body, it is necessary to grip the protecting cover with one hand such that the protecting cover does not move, and to press the process cartridge to be inserted into the apparatus main body with the other hand.

SUMMARY OF THE INVENTION

Therefore, the present invention provides a process cartridge, which can be easily mounted to an electrophotographic image forming apparatus main body without the necessity of gripping a protecting cover when the process cartridge is mounted to the apparatus main body, and an electrophotographic image forming apparatus to which the process cartridge is to be mounted.

The present invention provides a process cartridge, which can be easily positioned with respect to the apparatus main body and can be smoothly inserted into the apparatus main body when the process cartridge is mounted to the apparatus main body, and an electrophotographic image forming apparatus to which the process cartridge is to be mounted.

Further, the present invention provides a process cartridge detachably mountable to an apparatus main body of an electrophotographic image forming apparatus. The process cartridge includes: a photosensitive drum; a photosensitive unit having the photosensitive drum rotatably mounted thereto; and a protecting cover mountable to the apparatus main body, for protecting the photosensitive drum exposed to the outside from the photosensitive unit. The protecting cover includes: a guide portion for guiding the process cartridge to an inside of the apparatus main body along a longitudinal direction of the photosensitive drum; a positioned portion provided at a leading end of the protecting cover in an insertion direction in which the process cartridge is inserted into the apparatus main body so that the positioned portion is abutted against a positioning portion provided to the apparatus main body, for positioning the protecting cover with respect to the apparatus main body in a direction crossing the longitudinal direction; and an engaged portion provided at the leading end of the protecting cover in the insertion direction to be engaged with an engaging portion provided to the apparatus main body, for regulating detachment of the protecting cover from the apparatus main body toward an upstream side of the process cartridge in the insertion direction.

Furthermore, the present invention provides an electrophotographic image forming apparatus, for forming an image on a recording medium, including: (i) a positioning portion; (ii) an engaging portion; and (iii) a mounting unit for detachably mounting a process cartridge. The process cartridge includes: a photosensitive drum; a photosensitive unit having the photosensitive drum rotatably mounted thereto; and a protecting cover mountable to an apparatus main body of the electrophotographic image forming apparatus, for protecting the photosensitive drum exposed to the outside from the photosensitive unit. The protecting cover includes: a guide portion for guiding the process cartridge to an inside of the apparatus main body along a longitudinal direction of the photosensitive drum; a positioned portion provided at a leading end of the protecting cover in an insertion direction in which the process cartridge is inserted into the apparatus main body so that the positioned portion is abutted against a positioning portion provided on the apparatus main body, for positioning the protecting cover with respect to the apparatus main body in a direction crossing the longitudinal direction; and an engaged portion provided at the leading end of the protecting cover in the insertion direction to be engaged with the engaging portion, for regulating movement of the protecting cover to an upstream side of the process cartridge in the insertion direction with respect to the apparatus main body. The apparatus also includes (iv) a conveying unit for conveying the recording medium.

Further features of the present invention will become apparent from the following description of an exemplary embodiment with reference to the attached drawings.

DESCRIPTION OF THE EMBODIMENTS

Hereinafter, a process cartridge and an electrophotographic image forming apparatus according to the present invention will be described in more detail with reference to the attached drawings.

Embodiment 1

An electrophotographic image forming apparatus according to an embodiment of the present invention will be described. An electrophotographic image forming apparatus according to Embodiment 1 of the present invention is a color electrophotographic image forming apparatus.

(Overall Construction of Electrophotographic Image Forming Apparatus)

Figure 1:
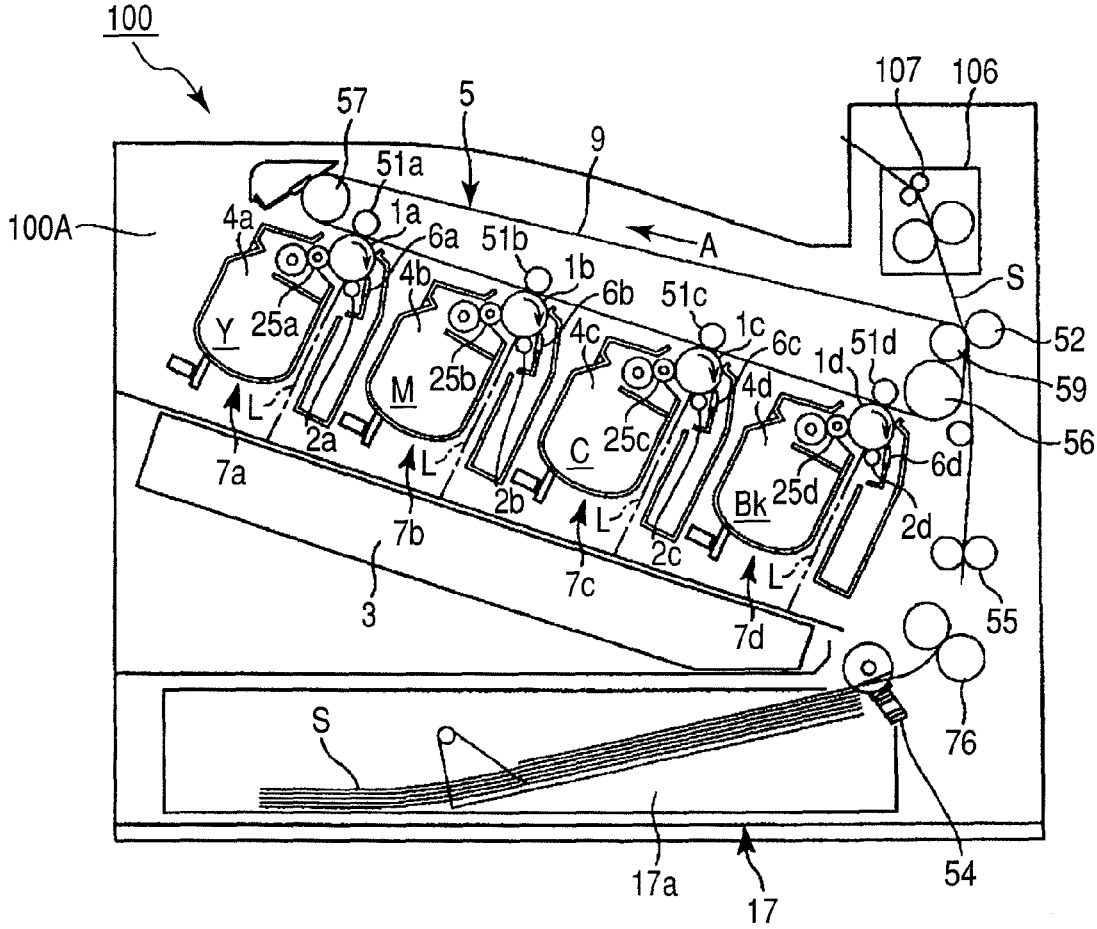
FIG. 1 is an overall structural diagram of a color electrophotographic image forming apparatus, which is an electrophotographic image forming apparatus according to Embodiment 1 of the present invention.

First, with reference to FIG. 1, a description will be provided of the overall construction of the color electrophotographic image forming apparatus according to Embodiment 1 of the present invention.

The color electrophotographic image forming apparatus (hereinafter referred to as "image forming apparatus") 100 illustrated in FIG. 1 includes four process cartridges (hereinafter referred to as "cartridge") 7 (7*a*, 7*b*, 7*c*, 7*d*) which are inclined with respect to a horizontal direction and are arranged in parallel with each other. Each cartridge 7 is detachably mountable to a mounting opening portion 82*b* (see FIG. 3).

Each cartridge 7 includes a drum-shaped electrophotographic photosensitive member (hereinafter referred to as "photosensitive drum") 1 (1*a*, 1*b*, 1*c*, 1*d*) serving as a single image bearing member, which is provided in an upper portion thereof. The photosensitive drum 1 is rotationally driven clockwise as illustrated in FIG. 1 by a driving member (not shown). In the vicinity of the photosensitive drum 1, the following constructions are provided in order in a rotational direction thereof.

That is, there are provided a cleaning member 6 (6*a*, 6*b*, 6*c*, 6*d*) for removing a developer remaining on a surface of the photosensitive drum 1 after transfer, a charging roller 2 (2*a*, 2*b*, 2*c*, 2*d*) for uniformly charging the surface of the photosensitive drum 1, and a scanner unit 3 for forming an electrostatic latent image on the photosensitive drum 1 through irradiation of a laser beam based on image information.

In addition, in the vicinity of the photosensitive drum 1, there is provided a developing unit 4 (4*a*, 4*b*, 4*c*, 4*d*) for developing the electrostatic latent image formed on the photosensitive drum 1 by the use of the developer (hereinafter referred to as "toner") to form a developer image (hereinafter referred to as "toner image").

Further, in the vicinity of the photosensitive drum 1, a transfer unit 5 is provided. The transfer unit 5 may have a structure using an intermediate transfer belt or a structure using a sheet conveyor belt. In Embodiment 1 of the present invention, a description is provided of a case where the structure using the intermediate transfer belt is employed. Specifically, in Embodiment 1, the transfer unit 5 serves as an intermediate transfer unit 5 for collectively transferring four color toner images formed on the photosensitive drums 1. The intermediate transfer unit 5 includes an intermediate transfer belt 9, which is passed around rollers 56, 57, and 59 and rotated in a direction indicated by an arrow A.

In this case, the photosensitive drum 1, the cleaning member 6, the charging roller 2, and the developing unit 4 are integrally formed into a cartridge, thereby constituting the cartridge 7.

Further, at a position opposed to each photosensitive drum 1 through the intermediate transfer belt 9, a primary transfer roller (51*a*, 51*b*, 51*c*, 51*d*) is provided.

At the right side of FIG. 1, the intermediate transfer belt 9 is opposed to and is in contact with a secondary transfer roller 52.

Further, at a lower portion of an image forming apparatus main body (hereinafter referred to as "apparatus main body") 100A, there is provided a sheet feed device 17 which includes a sheet feed cassette 17*a* containing a recording medium S which is a transfer material, a sheet feed roller 54 for feeding the recording medium S, and a conveyance roller pair 76 for conveying the recording medium S.

(Process Cartridge)

Figure 2:
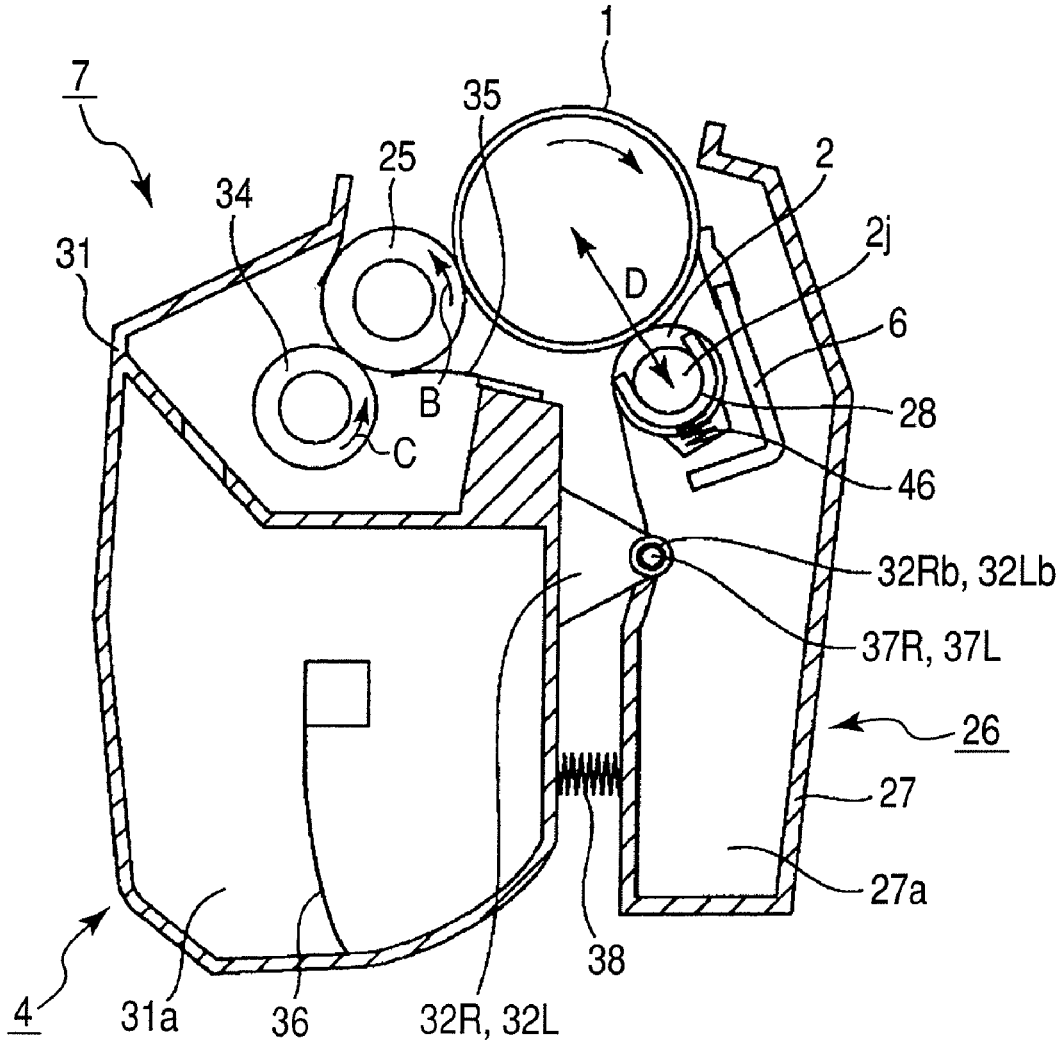
FIG. 2 is a cross-sectional diagram of a process cartridge according to Embodiment 1 of the present invention.

Next, with reference to FIG. 2, a description is provided of the cartridge 7 according to Embodiment 1 of the present invention.

FIG. 2 illustrates a principal section of the cartridge 7 containing a developer, that is, a toner.

Note that the cartridge 7*a* containing a yellow toner, the cartridge 7*b* containing a magenta toner, the cartridge 7*c* containing a cyan toner, and the cartridge 7*d* containing a black toner have the same structure. Accordingly, in the following description, the cartridges 7*a*, 7*b*, 7*c*, and 7*d* are collectively referred to as "cartridge 7". The structures of the respective cartridges are also collectively described below.

The cartridge 7 is divided into a photosensitive unit 26 serving as a first frame including the photosensitive drum 1, the charging roller 2, and the cleaning member 6, and the developing unit 4 serving as a second frame including a developing member such as a developing roller 25.

With respect to a cleaning frame 27 of the photosensitive unit 26, the photosensitive drum 1 is rotatably mounted through a bearing (not shown). On the periphery of the photosensitive drum 1, there are provided the charging roller 2 and the cleaning member 6 as described above. A residual toner removed from the surface of the photosensitive drum 1 by the cleaning member 6 is dropped into a removed toner chamber 27*a*. Then, a drive force of a drive motor (not shown) is transmitted to the photosensitive unit 26, thereby rotationally driving the photosensitive drum 1 according to an image forming operation. A charging roller bearing 28 is mounted to the cleaning frame 27 such that the charging roller bearing 28 can be moved in a direction indicated by an arrow D passing through the center of the charging roller 2 and the center of the photosensitive drum 1. A shaft 2*j* of the charging roller 2 is rotatably mounted to the charging roller bearing 28. The charging roller bearing 28 is held in pressure contact with the photosensitive drum 1 by a charging roller pressure member 46.

The developing unit 4 includes the developing roller 25, which is in contact with the photosensitive drum 1 and which rotates in a direction indicated by an arrow B, and a developing frame 31. The developing roller 25 is rotatably supported by the developing frame 31 through bearing members (not shown) mounted at both sides of the developing frame 31. Further, on the periphery of developing roller 25, there are provided a toner supply roller 34, which is in contact with the developing roller 25 and rotated in a direction indicated by an arrow C, and a developing blade 35 for regulating a toner layer formed on the developing roller 25. In addition, in a toner containing portion (container) 31*a* of the developing frame 31, there is provided a toner conveying member 36 for stiffing the toner contained therein and for conveying the toner to the toner supply roller 34.

Further, the developing unit 4 is connected to the photosensitive unit 26, and rotates around shafts 37R and 37L, which are fitted into holes 32Rb and 32L.b provided to bearing members 32R and 32L, respectively. In a case of forming an image by using the cartridge 7, the developing unit 4 is urged by a pressure spring 38, with the result that the developing unit 4 is rotated around the shafts 37R and 37L so that the developing roller 25 is abutted against the photosensitive drum 1.

(Image Forming Operation)

With reference to FIG. 1, an image forming operation is described below.

First, the photosensitive drum 1 including each cartridge 7 is rotated by a drive force transmitting portion provided to the image forming apparatus main body 100A with a timing of the image formation. Then, the scanner unit 3 corresponding to each cartridge 7 is driven.

After that, the charging roller 2 is also driven by the rotation of the photosensitive drum 1 to be rotated. In this case, the charging roller 2 is applied with a charging bias. As a result, charges are uniformly applied onto the peripheral surface of the photosensitive drum 1.

The scanner unit 3 applies a laser beam L onto the peripheral surface of the photosensitive drum 1 based on the image information. As a result, an electrostatic latent image is formed on the peripheral surface of the photosensitive drum 1.

The developing roller 25 rotatably supported by the developing unit 4 develops the electrostatic latent image by using the toner, thereby forming a toner image on the photosensitive drum 1.

A positive bias is applied onto the primary roller (51*a*, 51*b*, 51*c*, 51*d*), thereby subsequently transferring the toner image onto the intermediate transfer belt 9 from the photosensitive drum 1 (1*a*, 1*b*, 1*c*, 1*d*). As a result, a color toner image with four toner images superimposed on the intermediate transfer belt 9. The toner image is conveyed to the secondary transfer roller 52 by the intermediate transfer belt 9.

The recording medium S, which is a transfer material, is fed to the conveyance roller pair 76 by the sheet feed roller 54 of the sheet feed device 17. After that, the recording medium S is conveyed by a registration roller pair 55, and then passes through an abutting portion at which the intermediate transfer belt 9 and the secondary transfer roller 52 are abutted against each other. In the abutting portion, the positive bias is applied onto the secondary transfer roller 52, thereby collectively transferring toner images onto the recording medium S from the intermediate transfer belt 9.

After that, the recording medium S is conveyed to a fixing portion 106. In the fixing portion 106, the developer image is thermally fixed onto the recording medium S. Then, the recording medium S is delivered from a delivery portion 107 to an outside of the image forming apparatus 100.

(Mounting Construction of Process Cartridge to Image Forming Apparatus Main Body)

Next, with reference to FIGS. 3 to 8, a description will be provided of a mounting construction in which the cartridge 7, which is a feature of the present invention, is mounted to the image forming apparatus main body 100A.

Figure 3:
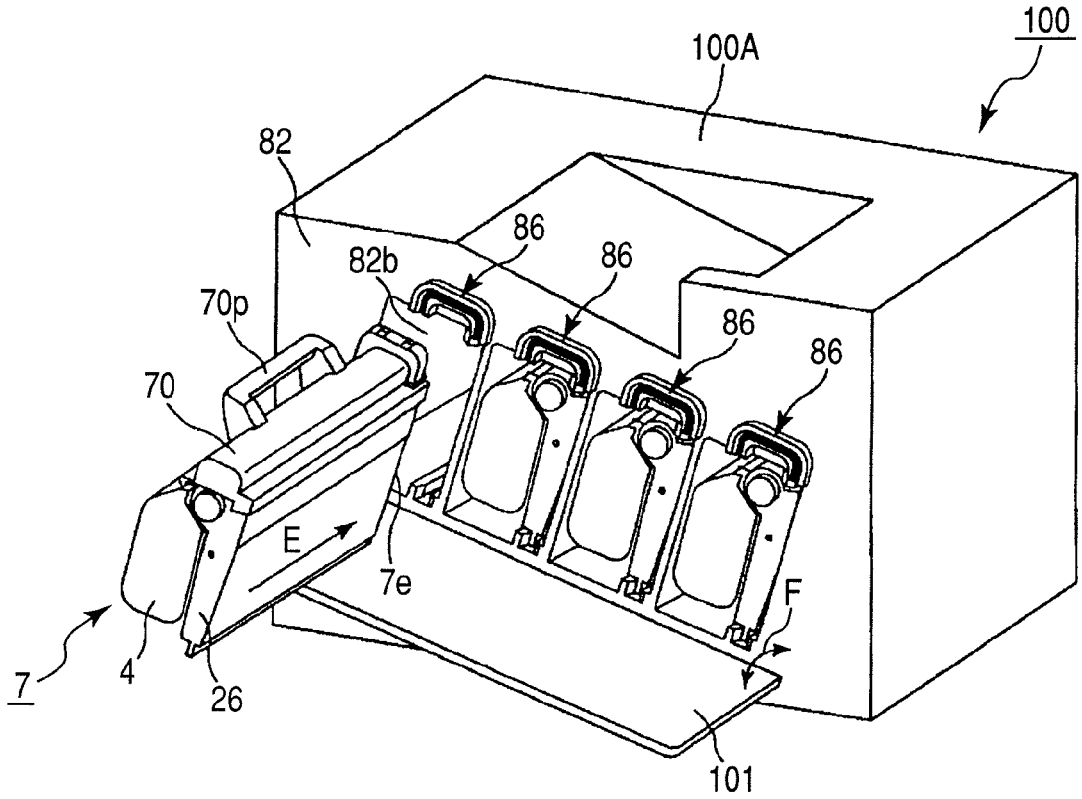
FIG. 3 is a perspective view illustrating a state of the process cartridge obtained before the process cartridge is inserted into an electrophotographic image forming apparatus main body.

FIG. 3 is a diagram illustrating a state of the process cartridge 7 obtained before the cartridge 7 is mounted to the apparatus main body 100A.

In FIG. 3, the cartridge 7 is mounted with a protecting cover 70 provided at an upper portion of the cartridge 7, for protecting the photosensitive drum 1 exposed from the photosensitive unit 26. As described in detail later, the protecting cover 70 is detachable in the longitudinal direction of the photosensitive drum 1 with respect to the photosensitive unit 26, that is, in a rotational axis direction (longitudinal direction) of the photosensitive drum 1. In addition, the protecting cover 70 is provided with a grip 70*p* capable of being gripped in a state where the grip 70*p* is mounted to the cartridge 7.

Further, the image forming apparatus main body 100A is provided with a front cover 101 capable of being opened and closed in directions indicated by the bidirectional arrow F in FIG. 3, and a front-side plate 82 having the mounting opening portion 82*b* which is an inlet for inserting the cartridge 7.

Further, the process cartridge 7 is mounted in such a manner that an insertion-direction leading end portion 7*e* of the process cartridge 7 is directed to the mounting opening portion 82*b* of the front-side plate 82 of the image forming apparatus main body 100A, and the process cartridge is inserted in the longitudinal direction (direction indicated by the arrow E in FIG. 3), that is, the rotational axis direction of the photosensitive drum 1.

Figure 5:
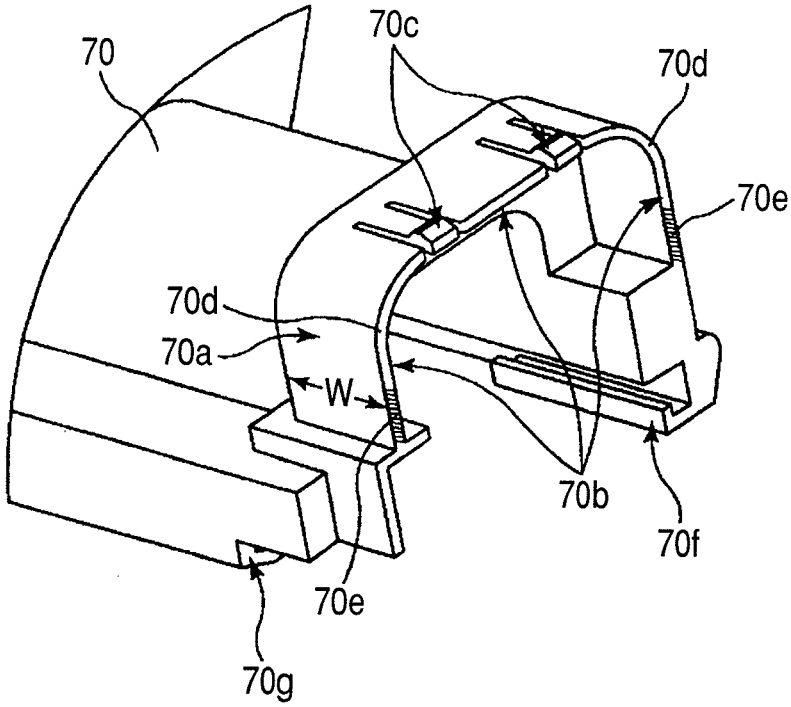
FIG. 5 is a detailed perspective view illustrating a positioned portion and an engaged portion of a protecting cover.
Figure 6:
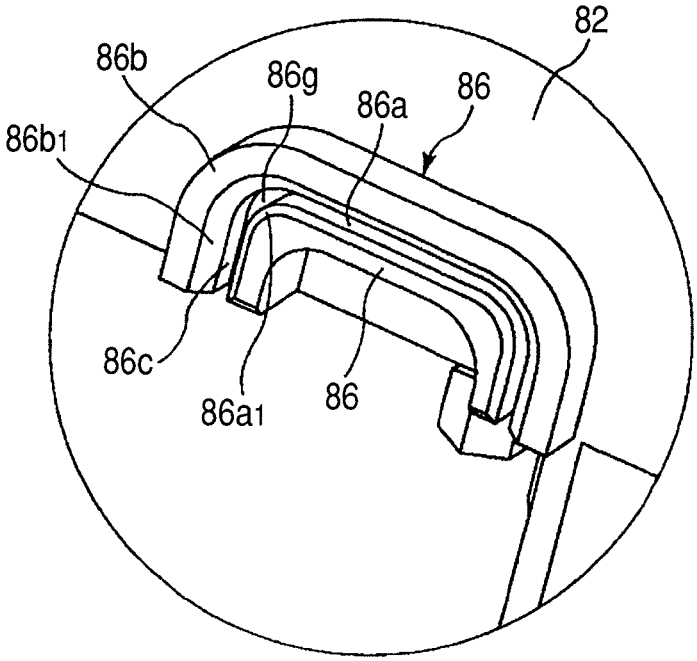
FIG. 6 is a detailed perspective view illustrating a positioning portion of a front-side plate of the electrophotographic image forming apparatus main body.

The front-side plate 82 is provided with a positioning portion 86, which is a convex portion with a U-shape (shape obtained by inverting a substantial U-shape) above the mounting opening portion 82*b*. As illustrated in FIG. 6, the positioning portion 86 is formed of an inner member 86*a* and an outer member 86*b*, each of which has a U-shape (a shape obtained by inverting a member that is substantially U-shaped). Between the inner member 86*a* and the outer member 86*b*, a groove portion 86*c* with a U-shape (a shape obtained by inverting a groove that is substantially U-shaped) is formed. As illustrated in FIG. 5 to be described later, into the groove portion 86*c*, a positioned portion 70*b*, which is provided to a leading end 70*a* with a U-shape (a shape obtained by inverting a member that is substantially U-shaped) that is formed at the insertion-direction leading end of the protecting cover 70 is inserted. In order to facilitate the insertion of the leading end portion 70*a*, at an inlet portion of the groove portion 86*c* between the inner member 86*a* and the outer member 86*b* which form the groove portion 86*c*, there are formed inclined surface portions 86*a*1 and 86*b*1 obtained through a chamfering.

Figure 4:
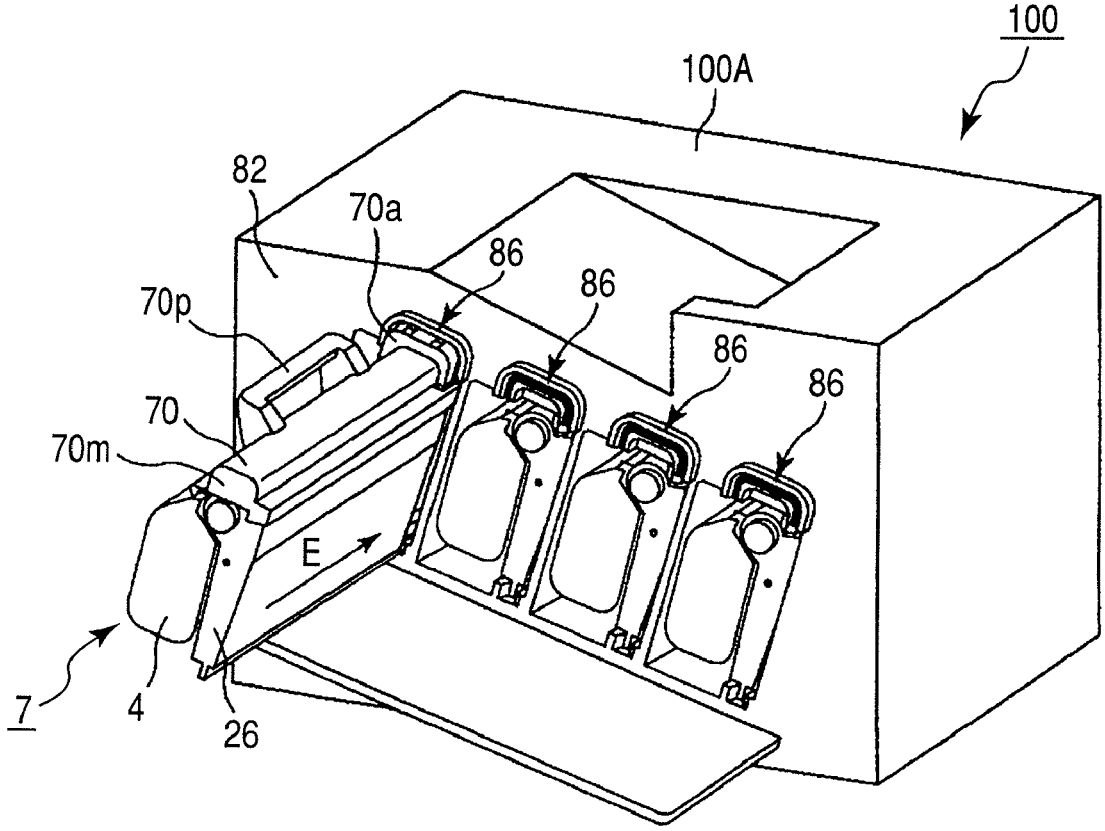
FIG. 4 is a perspective view illustrating a state of the process cartridge obtained immediately before the process cartridge is inserted into the electrophotographic image forming apparatus main body.
Figure 7:
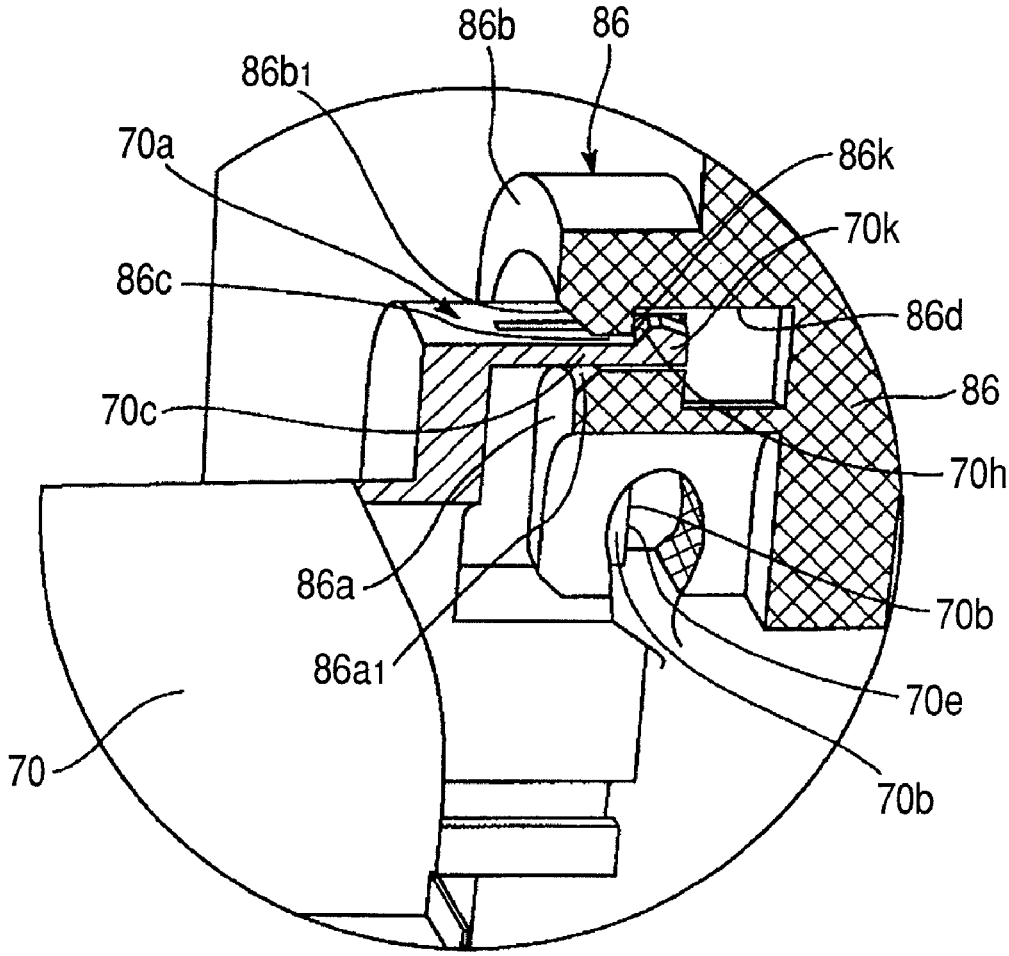
FIG. 7 is a perspective cross-sectional diagram illustrating a state where the engaged portion of the protecting cover is engaged with an engaging portion of the front-side plate.

Next, FIGS. 4 and 7 each illustrates a state of the cartridge 7 immediately before the cartridge 7 is inserted into the apparatus main body 100A.

In FIG. 4, the protecting cover 70 mounted to the cartridge 7 is positioned by the positioning portion 86 having the leading end portion 70*a* provided to the front-side plate 82 of the apparatus main body 100A.

Specifically, in Embodiment 1 of the present invention, as illustrated in FIG. 5, at an insertion-direction leading end portion of the protecting cover 70, there is formed the leading end portion 70*a* having a predetermined width (w) in the longitudinal direction of the protecting cover 70. As described above, the leading end portion 70*a* can be inserted into the groove portion 86*c* of the positioning portion 86 provided to the front-side plate 82.

More specifically, with reference to FIG. 5, the leading end portion 70*a* of the protecting cover 70 has the positioned portion 70*b* formed at the leading end portion thereof. In Embodiment 1 of the present invention, the positioned portion 70*b* of the protecting cover 70 is inserted into the groove portion 86*c* of the positioning portion 86, which is provided to the front-side plate 82 of the apparatus main body 100A illustrated in FIG. 6, thereby regulating (positioning) the vertical direction and the horizontal direction of the protecting cover 70 (direction crossing the rotational axis direction of photosensitive drum 1).

Further, as illustrated in FIG. 5, the protecting cover 70 is provided with engaged portions (claw shapes) 70*c* in an upper horizontal portion of the positioned portion 70*b* provided at the leading end portion 70*a*.

Further, as illustrated in FIG. 6, on a back side (bottom) of the groove portion 86*c* of the positioning portion 86, there is provided a back-side surface 86*g* which is an abutting portion for allowing an end surface 70*d* to be abutted, which is an abutted portion of the positioned portion 70*b* of the protecting cover 70.

In addition, as illustrated in FIG. 7, an engaging portion (groove portion) 86*d* is formed at a position corresponding to each of the engaged portions (claw shapes) 70*c* formed at the leading end portion 70*a* of the protecting cover 70, on the back side of the groove portion 86*c* of the positioning portion 86.

Accordingly, as illustrated in FIG. 7, in a case of inserting the leading end portion 70*a* into the groove portion 86*c* of the positioning portion 86 of the front-side plate 82, the engaged portion 70*c* is pressed particularly by the chamfered surface (inclined surface portion) 86*b*1 formed in an inner peripheral portion of the outer member 86*b* to be deformed downward, thereby being engaged with the engaging portion (groove portion) 86*d*. The engaged portion 70*c* is inserted into the engaging portion 86*d*, thereby eliminating the deflection of the engaged portion 70*c*. Thus, a claw portion 70*k* of the engaged portion 70*c* is engaged with an engaging portion side surface 86*k* of the engaging portion (groove portion) 86*d* provided on the positioning portion 86. As a result, the engaged portion 70*c* is engaged with the engaging portion 86*d*, thereby preventing the protecting cover 70 from coming off to the upstream side in the insertion direction.

Further, the protecting cover 70 on the front side (upstream side) in the insertion direction is inclined downward by the own weight of the cartridge 7 and the protecting cover 70, with a lower area 70*e* of the end surface 70*d* of the positioned portion 70*b* being set as a fulcrum. In this case, an abutting portion (inclined surface portion of claw portion) 70*h* provided on the engaged portion 70*c* of the protecting cover 70 is abutted against the engaging portion side surface 86*k* of the engaging portion 86*c*.

Accordingly, the claw portion 70*k* is engaged with the engaging portion 86*c*, thereby preventing the engaging portion 70*c* from coming off. As a result, the protecting cover 70 is held by the apparatus main body 100A and is prevented from being dropped from the apparatus main body 100A.

Figure 8:
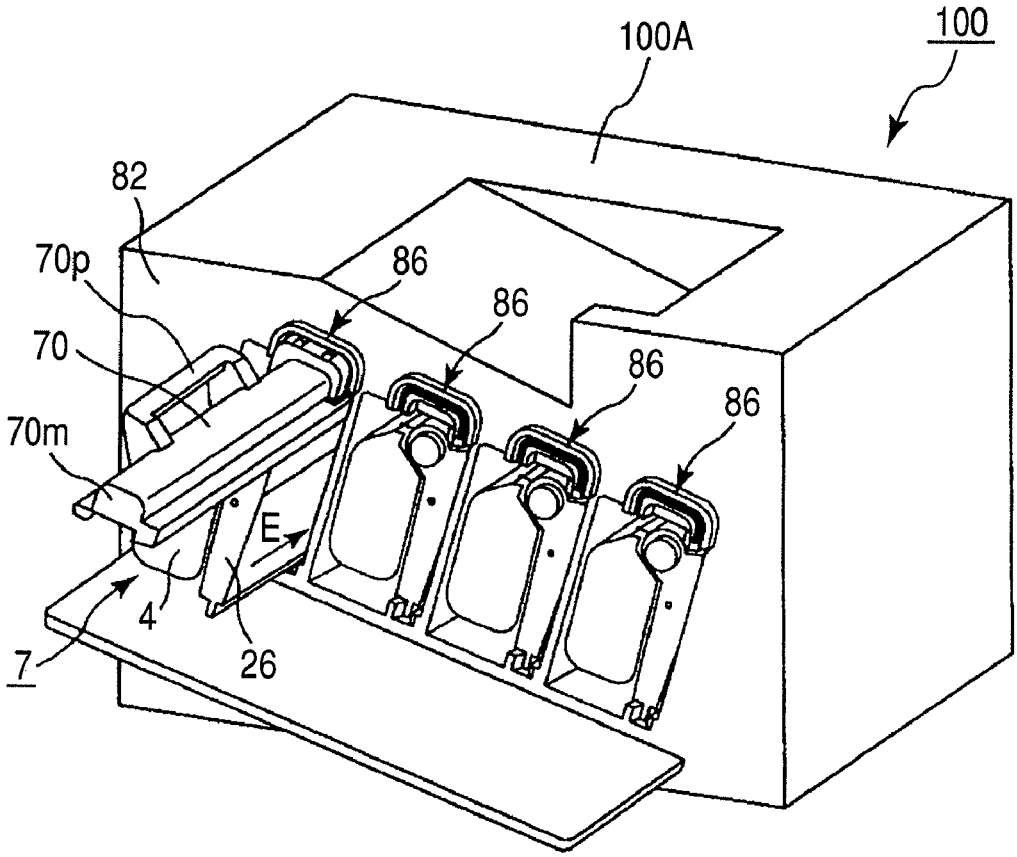
FIG. 8 is a perspective view illustrating a state where the process cartridge is to be inserted into the electrophotographic image forming apparatus main body.

FIG. 8 illustrates a state where the cartridge 7 is inserted into the apparatus main body 100A.

In FIG. 8, the cartridge 7 is held through positioning of the protecting cover 70 at the front-side plate 82 of the apparatus main body 100A, and is pressed in the longitudinal direction (direction indicated by the arrow E in FIG. 8), thereby being inserted into the apparatus main body 100A.

In this case, the protecting cover 70 is provided with a side plate 70*m*, which is a regulating portion, at a front side (upstream side) in the insertion direction of the cartridge 7, thereby regulating the end surface of the cartridge 7. Accordingly, the cartridge 7 is prevented from being slid to the front side when the protecting cover 70 is positioned with respect to the apparatus main body 100A.

As a result, the cartridge 7 can be pressed only to the back side, and is detached from the protecting cover 70 when the cartridge 7 is inserted into the apparatus main body 100A.

(Mounting Construction of Protecting Cover to Process Cartridge)

Figure 9:
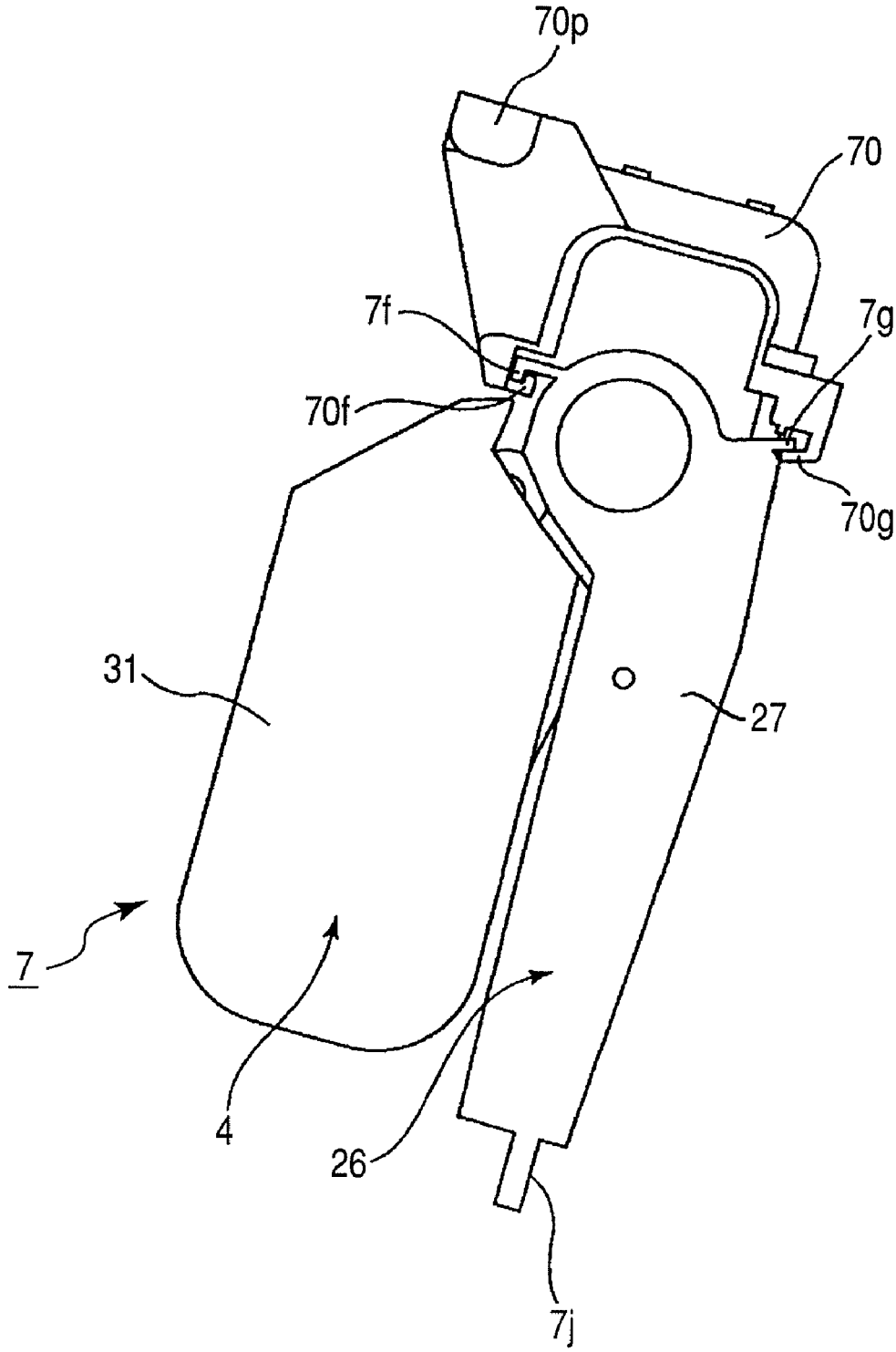
FIG. 9 is a side view of the process cartridge and the protecting cover.
Figure 10:
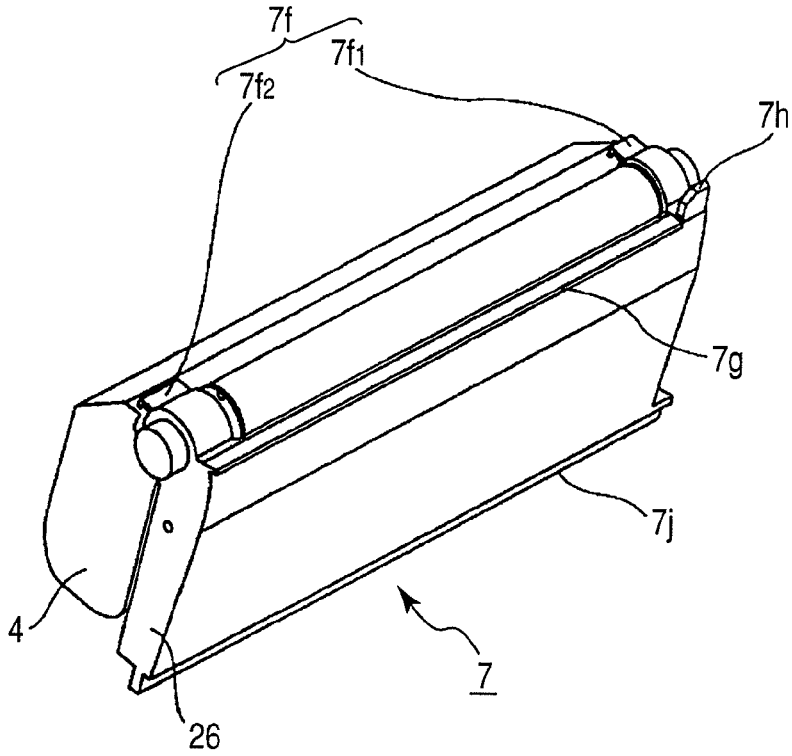
FIG. 10 is a perspective view illustrating guided portions of the process cartridge.
Figure 11:
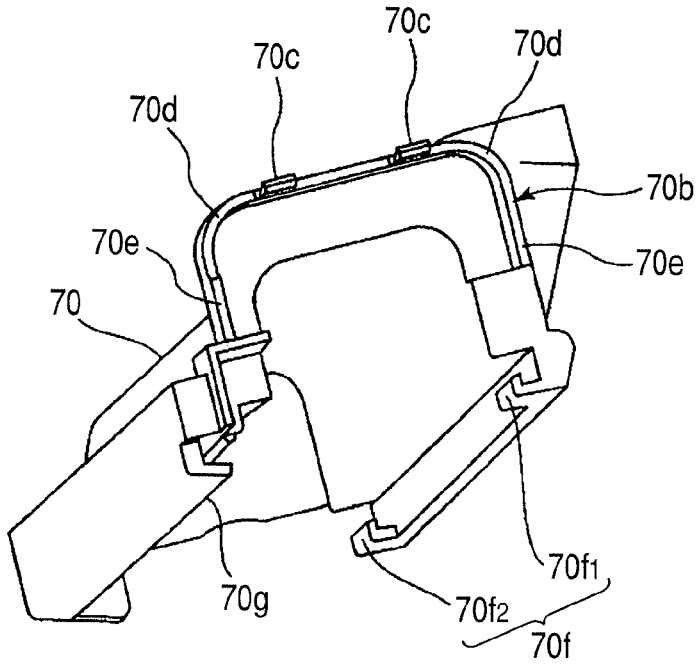
FIG. 11 is a perspective view illustrating guide portions of the process cartridge.

Next, with reference to FIGS. 9 to 11, a description will be provided of a state where the protecting cover 70 is mounted to (engaged with) the cartridge 7.

In Embodiment 1 of the present invention, as illustrated in FIG. 9, the photosensitive drum 1 is rotatably mounted to the cleaning frame 27 constituting the photosensitive unit 26 as described above. The photosensitive unit 26, that is, the cleaning frame 27 is provided with guided portions 7*f* and 7*g* positioned on both sides of the photosensitive drum 1.

Further, as illustrated in FIG. 10, the guided portions 7*f* (7*f*1 and 7*f*2) are provided at both ends in the longitudinal direction of the cartridge 7, and the guided portion 7*g* is provided over the entire area in the longitudinal direction.

On the other hand, as illustrated in FIG. 11, the protecting cover 70 has a cross section with a substantial U-shape (shape obtained by inverting a substantial U-shape) so as to cover the photosensitive drum 1, and is extended in the longitudinal direction of the cartridge 7. At one end of the protecting cover 70 in a lateral direction thereof, a guide portion 70*g* is continuously formed in the longitudinal direction over the entire area thereof. At the other end thereof in the lateral direction, there are provided guide portions 70*f* (70*f*1 and 70*f*2) at both ends in the longitudinal direction.

Further, the guide portions 70*f* of the protecting cover 70 are engaged with the guided portions 7*f* provided to the photosensitive unit 26, at both ends of the protecting cover 7 in the longitudinal direction. The guided portion 7*g* provided on the photosensitive unit 26 is engaged with the guide portion 70*g* over the entire length in the longitudinal direction. Accordingly, the cartridge 7 can be slid in the longitudinal direction with respect to the protecting cover 70. As a result, when the protecting cover 70 is positioned at the front-side plate 82 of the apparatus main body, the guide portions 70*f* and 70*g* of the protecting cover 70 each serve as a guide for the cartridge 7. With the construction, the cartridge 7 is guided to an inside of the apparatus main body 100A along the axial direction of the photosensitive drum 1. In this case, the end surface 70*d* (see FIG. 5) of the positioned portion 70*b* is abutted against the back-side surface 86*g* (see FIG. 6) of the positioning portion 86, thereby regulating movement of the protecting cover 70 in the insertion direction.

Figure 12:
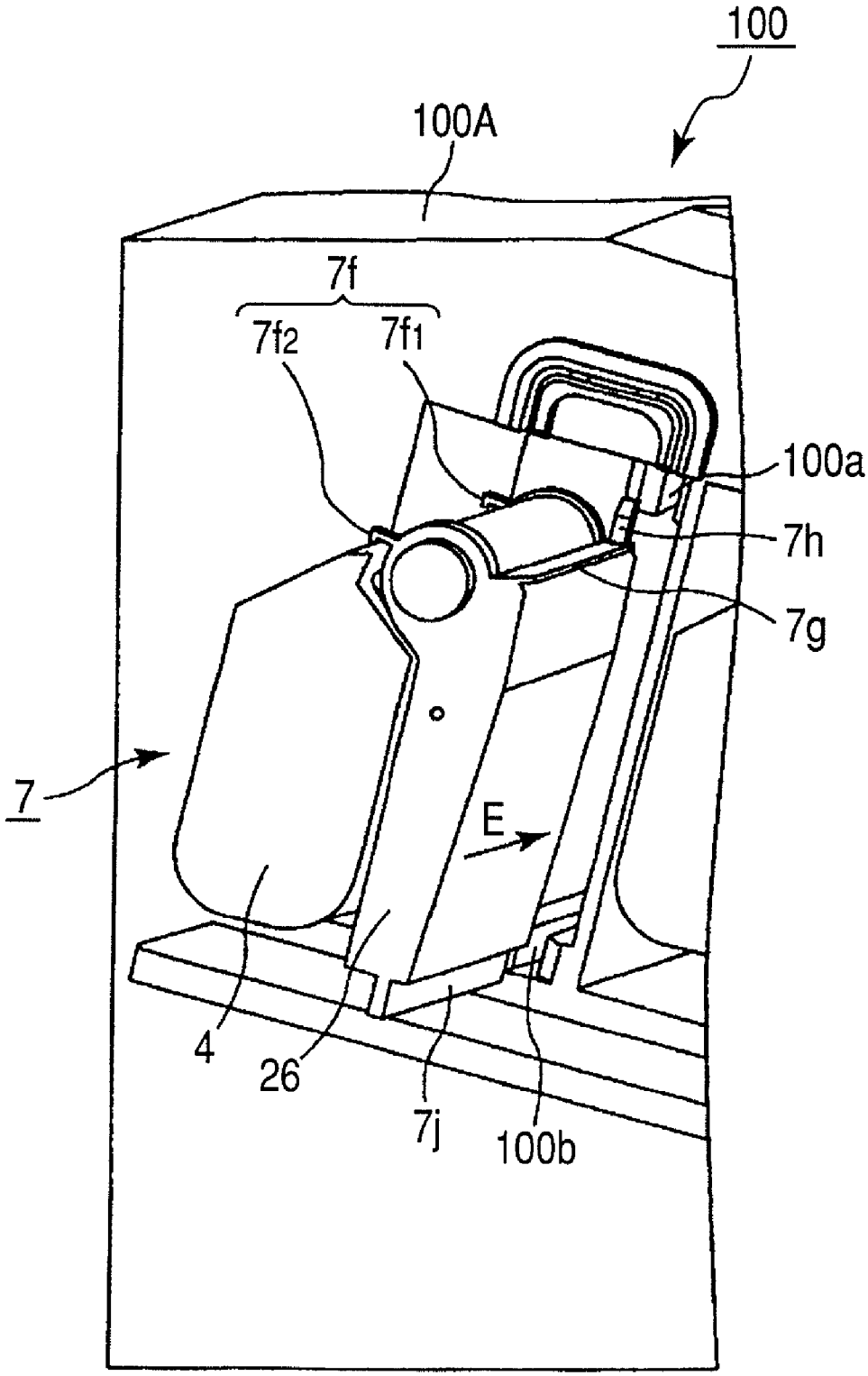
FIG. 12 is a perspective view illustrating the process cartridge and a guide construction of the electrophotographic image forming apparatus, and also illustrating a state where the protecting cover is detached from the electrophotographic image forming apparatus.

In other words, the guided portions 7*f* and 7*g* of the cartridge 7 are guided to the mounting direction (the direction indicated by the arrow E) by the guide portions 70*f* and 70*g* of the protecting cover 70. Accordingly, cartridge guide portions 7*h* and 7*j* (see FIG. 10) of the cartridge 7 are guided to apparatus main body guides (groove portions) 100*a* and 100*b* serving as mounting units of the apparatus main body 100A illustrated in FIG. 12. As a result, the cartridge 7 is mounted to the apparatus main body 100A.

Further, as described above, after the protecting cover 70 and the cartridge 7 are integrally positioned with respect to the apparatus main body 100A, the protecting cover 70 is engaged with and held by the apparatus main body 100A. Thus, in the construction according to Embodiment 1 of the present invention, the protecting cover 70 is prevented from being dropped (coming off) from the image forming apparatus main body 100A even when the cartridge 7 is to be inserted or after the cartridge 7 is inserted.

As described above, in the protecting cover 70, there are integrally formed the grip 70*p* capable of being gripped with the cartridge 7 in an integrated manner, and the leading end portion 70*a* including the positioned portion 70*b* used for the positioning when the cartridge 7 is to be mounted. As a result, the grip of the cartridge 7 and the positioning for the insertion thereof can be performed by the same component.

Accordingly, the process cartridge 7 is insusceptible to rattle or the like caused between the protecting cover 70 and the cartridge 7, so operability and mountability of the process cartridge 7 can be improved.

Further, the engaged portions 70*c* of the leading end portion 70*a* are engaged with the engaging portions 86*d* of the apparatus main body 100A, thereby holding the protecting cover 70. As a result, with the construction, the protecting cover 70 is prevented from being dropped (coming off) from the apparatus main body 100A. For this reason, the cartridge can be easily inserted into the apparatus main body 100A.

Figure 13:
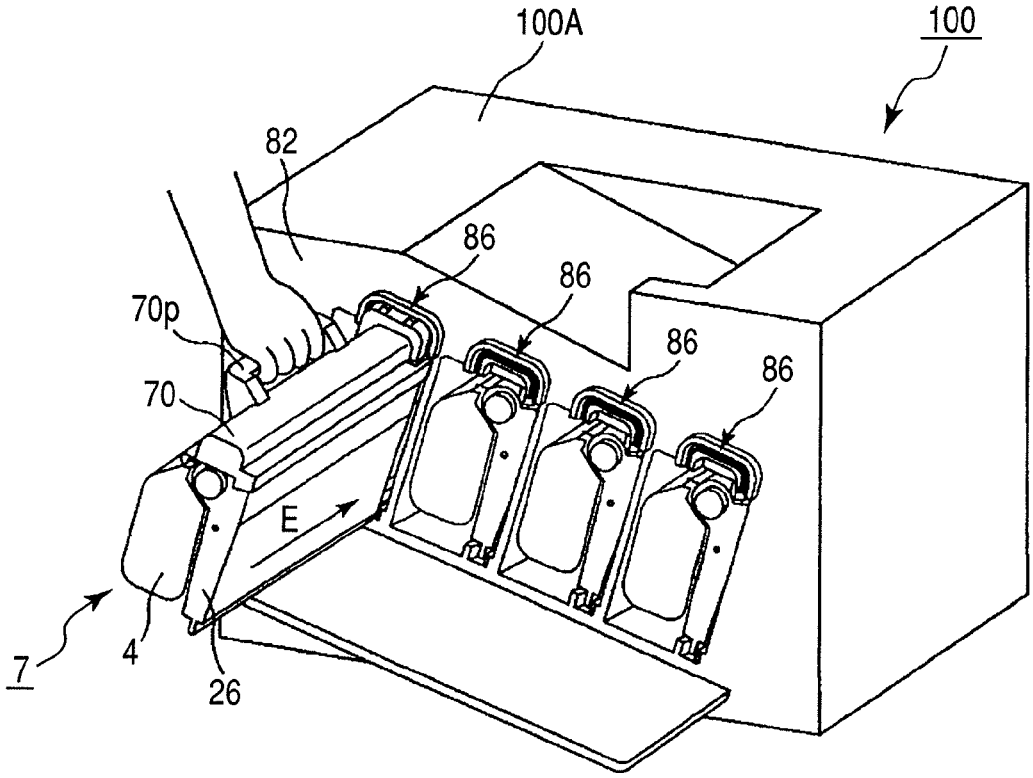
FIG. 13 is a perspective view illustrating an operation executed before insertion of the process cartridge.
Figure 14:
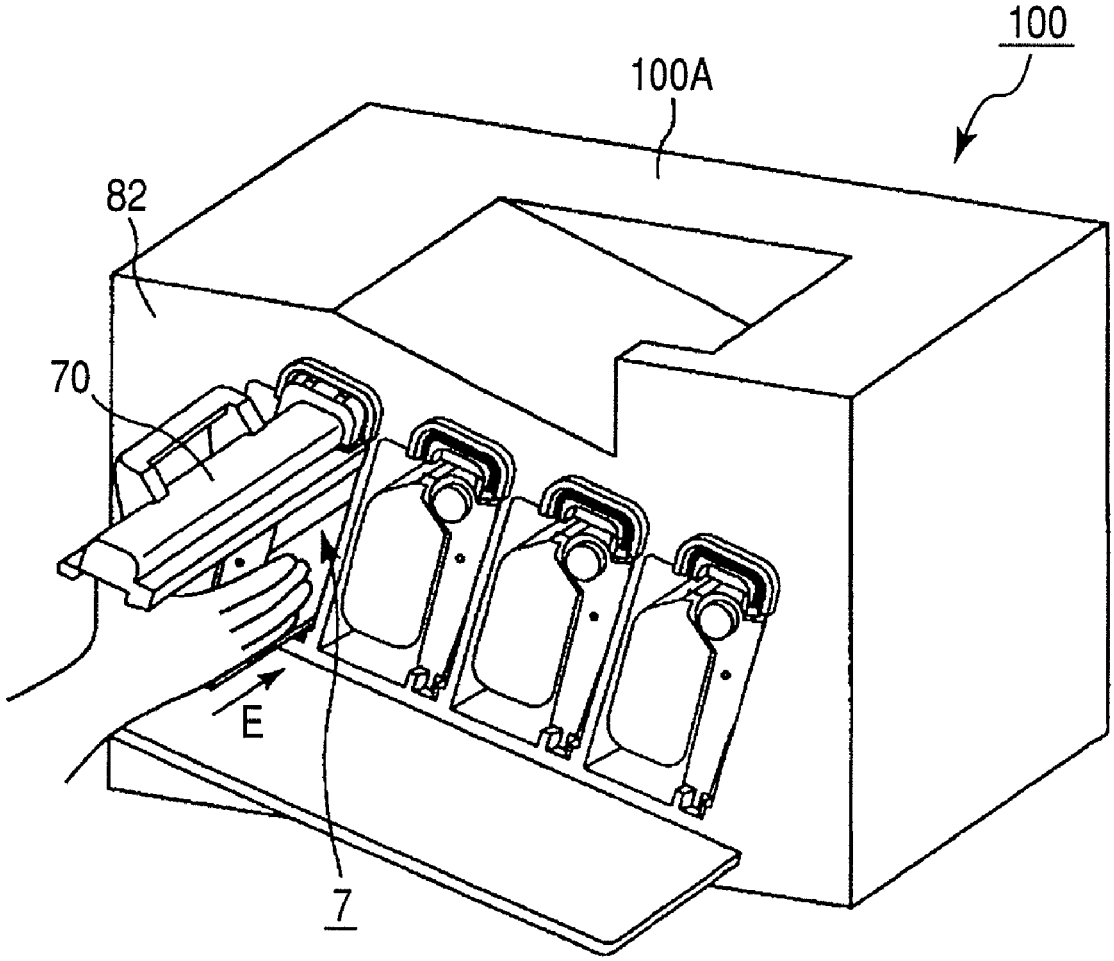
FIG. 14 is a perspective view illustrating an operation of inserting the process cartridge.

Accordingly, as illustrated in FIG. 13, the grip 70*p* of the protecting cover 70 mounted to the cartridge 7 can be gripped with one hand, and the protecting cover 70 and the cartridge 7 can be integrally positioned. After that, as illustrated in FIG. 14, the process cartridge 7 can be gripped and inserted with one hand without the necessity of holding (gripping) the protecting cover 70 by a user. Accordingly, the mountability of the cartridge 7 can be improved.

In addition, the protecting cover 70 is positioned with respect to the apparatus main body 100A to be held, and the protecting cover 70 includes the guide portions 70*f* and 70*g* for mounting the cartridge 7, with the result that the protecting cover 70 is held at a precise position with respect to the apparatus main body 100A. Accordingly, the cartridge 7 can be smoothly mounted to the apparatus main body 100A.

Further, in Embodiment 1 of the present invention, the photosensitive drum 1 is provided at the upper portion of the cartridge 7, and the protecting cover 70 is attached to the cartridge 7. For this reason, the positioned portion 70*b* of the protecting cover 70 is positioned while being viewed from above, thereby enabling insertion of the cartridge 7. Specifically, the positions for positioning of the cartridge 7 with respect to the front-side plate 82 of the apparatus main body can be easily recognized, so the mountability of the cartridge 7 can be improved.

Embodiment 2

Next, with reference to FIGS. 15 to 19, a description is provided of an image forming apparatus according to another embodiment of the present invention. In Embodiment 2 of the present invention, the overall construction of the image forming apparatus is the same as that of the image forming apparatus described in Embodiment 1 of the present invention, and therefore, the description of Embodiment 2 omits a redundant description thereof by incorporating the description of Embodiment 1.

In the following, a description will be provided of structures of characterized portions of the present invention, which are different from those of Embodiment 1. Also in this case, the same components as those of Embodiment 1 are denoted by the same reference symbols, and a detailed description thereof is omitted by incorporating the description of Embodiment 1.

Next, portions different from those of Embodiment 1 will be described.

Figure 15:
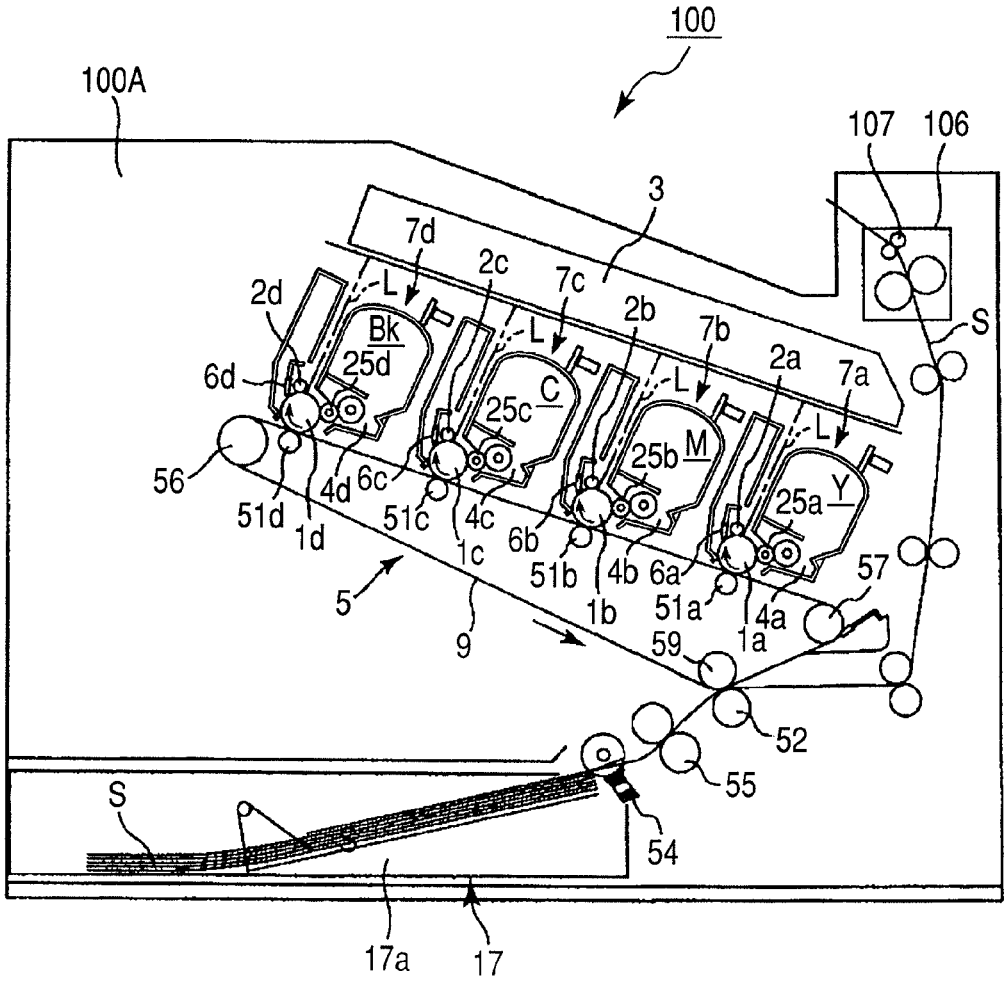
FIG. 15 is an overall block diagram of a color electrophotographic image forming apparatus, which is an electrophotographic image forming apparatus according to Embodiment 2 of the present invention.
Figure 16:
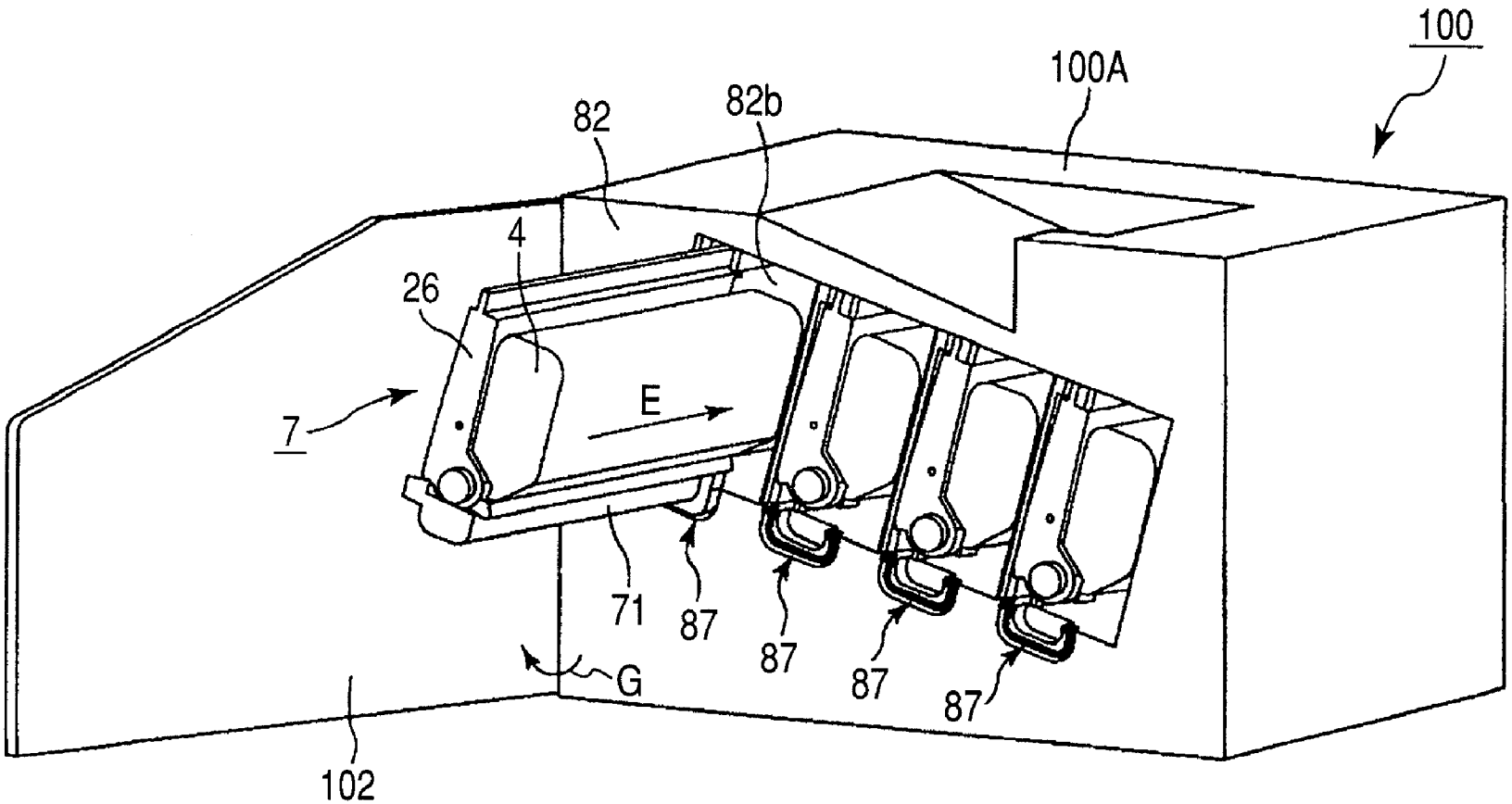
FIG. 16 is a perspective view illustrating a state where the process cartridge according to Embodiment 2 of the present invention is to be inserted.

In Embodiment 2 of the present invention, as illustrated in FIGS. 15 and 16, the photosensitive drum 1 is disposed downward with respect to the process cartridge (hereinafter referred to as "cartridge") 7. A protecting cover 71 is disposed on a lower side of the photosensitive drum 1.

Further, as illustrated in FIG. 16, the image forming apparatus main body (hereinafter referred to as "apparatus main body") 100A is provided with a front cover 102 capable of being opened and closed in a direction indicated by the arrow G, and the front-side plate 82 having the mounting opening portion 82*b* which is an inlet for inserting the cartridge 7.

Figure 17:
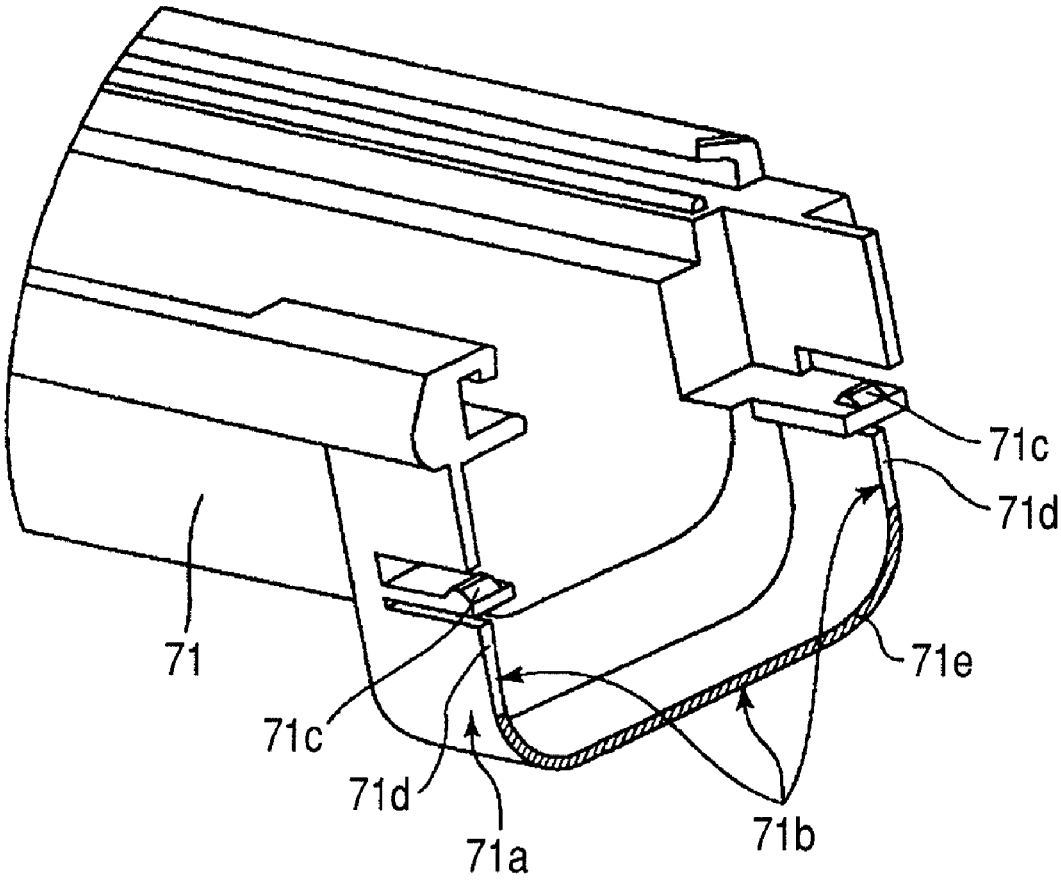
FIG. 17 is a detailed perspective view illustrating a positioned portion and an engaged portion of a protecting cover according to Embodiment 2 of the present invention.

The protecting cover 71 is positioned at a positioning portion 87 of the front-side plate 82 provided to the apparatus main body 100A in the same manner as in Embodiment 1. In this case, a positioned portion 71*b* provided at a leading end portion 71*a* of the protecting cover 71 illustrated in FIG. 17 is inserted into a groove portion 87*c* having a U-shape (substantial U-shape) of the positioning portion 87 having a U-shape (substantial U-shape) provided on the front-side plate 82 illustrated in FIG. 18. Thus, the vertical direction and the horizontal direction of the protecting cover 71 (directions crossing the rotational axis direction of the photosensitive drum 1) are regulated (positioned).

Further, as illustrated in FIG. 17, the protecting cover 71 is provided with engaged portions (claw shapes) 71*c* at both ends of the upper portion of the positioned portion 71*b* of the leading end portion 71*a*. In addition, the protecting cover 71 is provided with an end surface 71*d* and a lower portion 71*e* of the positioned portion 71*b*.

Figure 18:
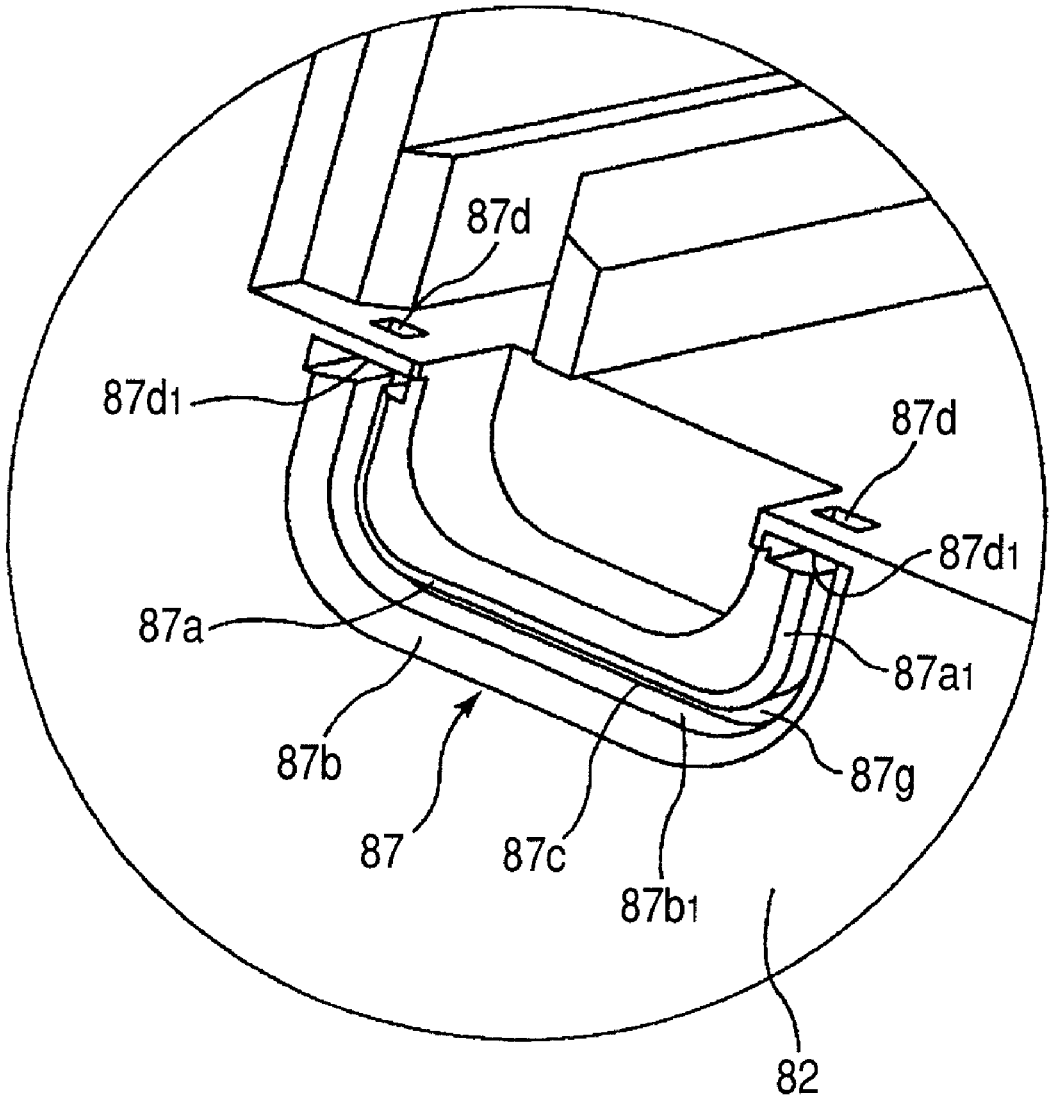
FIG. 18 is a detailed perspective view of a front-side plate of the electrophotographic image forming apparatus according to Embodiment 2 of the present invention.

Further, as illustrated in FIG. 18, at the upper portion of the positioning portion 87, there are provided engaging portions (groove portions) 87*d* with which the protecting cover 71 to be described later is to be engaged. On the back side (bottom) of the positioning portion 87, there is provided a back-side surface 87*g* which is an abutting portion for allowing an end surface 71*d* to be abutted, which is an abutted portion of the protecting cover 71.

Figure 19:
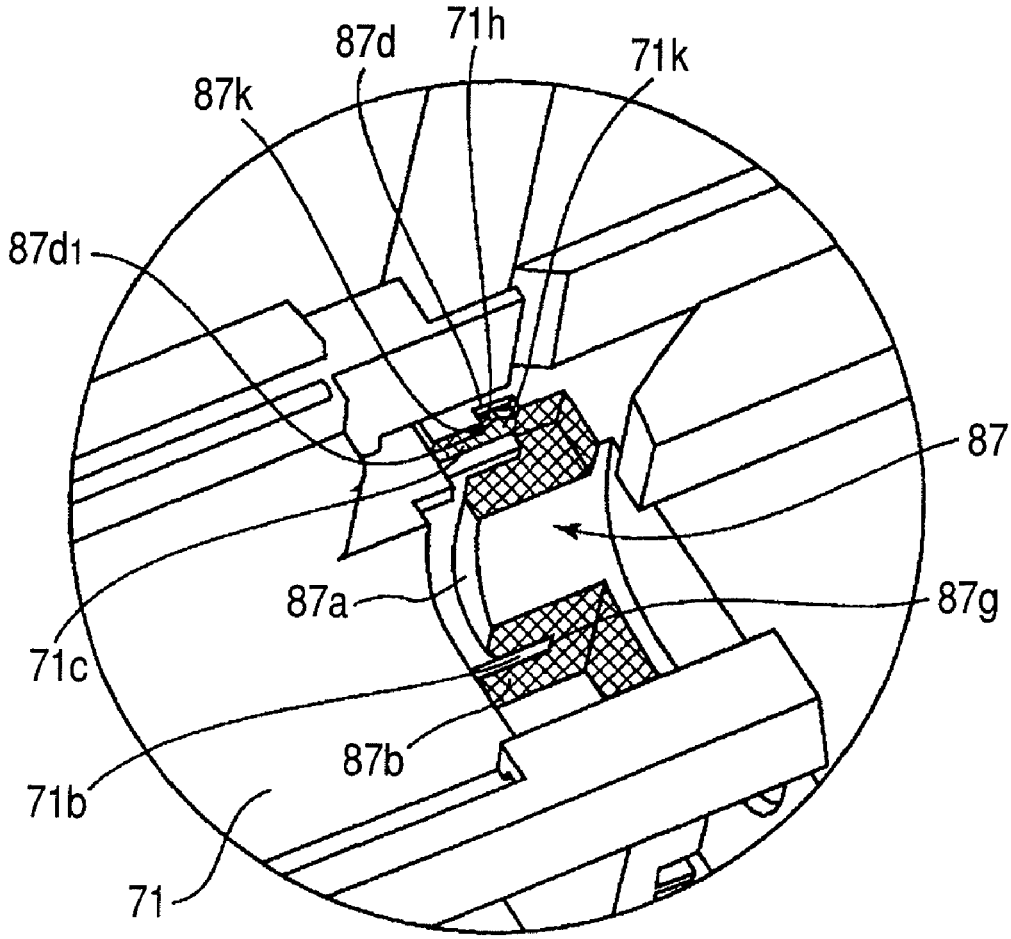
FIG. 19 is a perspective cross-sectional diagram illustrating a state where the engaged portions of the protecting cover are engaged with the front-side plate according to Embodiment 2 of the present invention.

As illustrated in FIG. 19, when the protecting cover 71 is inserted into the positioning portion 87, the engaged portions 71*c* of the protecting cover 71 are pressed by an inclined surface portion 87*d*1 to be deformed downward, thereby engaging the engaging portions (groove portions) 87*d*. Thus, the deformation of the engaged portions 71*c* is eliminated so that a claw portion 71*k* of the engaging portion 71*c* is engaged with an end surface 87*k* of the engaging portion (groove portion) 87*d*. As a result, the engaged portions 71*c* are engaged with the engaging portions 87*d*.

The protecting cover 71 on the front side (upstream side) in the insertion direction is inclined downward with the aid of the gravitational force of the cartridge 7 and the protecting cover 71, with a lower area 71*e* of the positioned portion 71*b* being set as a fulcrum. In this case, an abutting portion (inclined surface portion of claw portion) 71*h* provided to each of the engaged portions 71*c* of the protecting cover 71 is abutted against the engaging portion side surface 87*k* of the engaging portion 87*d*.

Accordingly, the claw portion 71*k* is engaged with the engaging portion 87*d* so as to prevent the engaging portion 71 from being detached. As a result, the protecting cover 71 is held so as not to be dropped (come off) from the apparatus main body 100A.

In the operation of inserting the cartridge 7, in the same manner as in Embodiment 1, the cartridge is pressed in the direction indicated by the arrow E illustrated in FIG. 16, and the cartridge is guided to the apparatus main body guide portions of the apparatus main body 100A by the guide portions of the protecting cover 71, thereby mounting the cartridge 7 to the apparatus main body 100A. In this case, the end surface 71*d* (see FIG. 17) of the positioned portion 71*b* is abutted against the back-side surface 87*g* (see FIG. 18) of the positioning portion 87, thereby regulating movement of the protecting cover 71 in the insertion direction.

As described above, the protecting cover 71 is positioned with respect to the apparatus main body 100A to be held, thereby performing the insertion of the cartridge 7. Accordingly, in the case of inserting the cartridge 7, it is unnecessary to provide a receiving tray of the image forming apparatus, for placing and positioning the protecting cover 71 thereon. Accordingly, the image forming apparatus main body 100A can be downsized.

Further, in this embodiment the protecting cover 71 is held, which is convenient even in a case of employing a construction in which the front cover 102 of the apparatus main body 100A as illustrated in FIG. 16 is opened in the horizontal direction. In other words, with the construction of Embodiment 2 of the present invention, the cartridge 7 can be inserted without gripping the protecting cover 71. Also in this case, the protecting cover 71 can be prevented from being dropped from the apparatus main body 100A.

Accordingly, the cartridge 7 can be gripped and inserted with one hand, so the mountability of the cartridge 7 can be improved.

Further, the guide of the protecting cover 71 guides the cartridge 7 to a cartridge guide (not shown), which is a mounting unit of the apparatus main body 100A, so the cartridge 7 can be smoothly mounted. As a result, the mountability of the cartridge 7 can be improved.

Note that, in Embodiment 2 of the present invention, a description has been provided of the construction in which the claw shapes are provided to the protecting cover and the groove shapes are provided to the image forming apparatus main body. However, even when the relationship therebetween is reversed, the same effects can be obtained.

As described above, in the present invention, the protecting cover is mounted to the image forming apparatus main body without coming off. As a result, when the process cartridge is mounted to the apparatus main body, the process cartridge can be easily mounted without the necessity of gripping the protecting cover. Therefore, operability and an insertion performance by the user can be improved.

Further, when the process cartridge is mounted to the apparatus main body, the process cartridge can be easily positioned with respect to the apparatus main body, and can be smoothly inserted therein. Therefore, the operability and the insertion performance by the user can be improved.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2006-333859, filed Dec. 11, 2006, and 2007-294950, filed Nov. 13, 2007, which are hereby incorporated by reference in their entirety.

What is claimed is:

1. A process cartridge comprising:

a photosensitive drum;

a photosensitive unit to which said photosensitive drum is rotatably mounted; and a protecting cover provided at an upper portion of said process cartridge when said process cartridge is mounted to an apparatus main body of an electrophotographic image forming apparatus, said protecting cover being mountable to the apparatus main body, said protecting cover protecting said photosensitive drum exposed to an outside from the photosensitive unit, said protecting cover including:

a guide portion that guides said process cartridge to an inside of the apparatus main body along a longitudinal direction of said photosensitive drum;

a positioned portion provided at a leading end of said protecting cover in an insertion direction in which said process cartridge is inserted into the apparatus main body so that said positioned portion is abutted against a positioning portion provided on the apparatus main body to position said protecting cover with respect to the apparatus main body in a direction crossing the longitudinal direction; and an engaged portion provided at the leading end of said protecting cover in the insertion direction to be engaged with an engaging portion provided on the apparatus main body in the insertion direction to regulate detachment of said protecting cover from the apparatus main body toward an upstream side of said process cartridge, upstream with respect to the insertion direction.

2. A process cartridge according to claim 1, wherein said protecting cover includes an abutted portion to be abutted against an abutting portion provided to the apparatus main body in the insertion direction, that regulates movement of said protecting cover in the insertion direction.

3. A process cartridge according to claim 1, wherein said protecting cover is provided on an upper portion of said process cartridge so that said protecting cover protects said photosensitive drum exposed to the outside from said photosensitive unit.

4. A process cartridge according to claim 3, wherein said protecting cover includes a grip grippable in a state in which said process cartridge is engaged with said guide portion.

5. A process cartridge according to claim 1, wherein said protecting cover includes a regulating portion provided on the upstream side of said process cartridge in the insertion direction, that regulates movement of said process cartridge toward the upstream side thereof in the insertion direction when said protecting cover is mounted to the apparatus main body.

6. A process cartridge according to claim 1, wherein said engaged portion is abutted against the positioning portion to be deformed when said protecting cover is mounted to the apparatus main body, and a deformation of said engaged portion is eliminated and said engaged portion is engaged with the engaging portion when said protecting cover is positioned by the positioning portion.

7. An electrophotographic image forming apparatus comprising:

(i) a positioning portion;

(ii) an engaging portion;

(iii) a mounting unit configured to mount a process cartridge including a photosensitive drum, a photosensitive unit to which the photosensitive drum is rotatably mounted, and a protecting cover provided at an upper portion of the process cartridge when the process cartridge is mounted to an apparatus main body of said apparatus by said mounting unit, the protecting cover being mountable to said apparatus main body of said electrophotographic image forming apparatus, and protecting the photosensitive drum exposed to the outside from the photosensitive unit, the protecting cover including a guide portion that guides the process cartridge to an inside of said apparatus main body along a longitudinal direction of the photosensitive drum, a positioned portion provided at a leading end of the protecting cover in an insertion direction in which the process cartridge is inserted into said apparatus main body so that the positioned portion is abutted against said positioning portion to position the protecting cover with respect to said apparatus main body in a direction crossing the longitudinal direction, and an engaged portion provided at the leading end of the protecting cover in the insertion direction to be engaged with said engaging portion in the insertion direction to regulate movement with respect to the apparatus main body of the protecting cover toward an upstream side of the process cartridge, upstream with respect to the insertion direction; and (iv) a conveying unit that conveys a recording medium on which an image is to be formed.

8. An electrophotographic image forming apparatus according to claim 7, wherein said positioning portion comprises a groove provided on said apparatus main body so as to be engaged with the positioned portion.

9. An electrophotographic image forming apparatus according to claim 7, wherein said electrophotographic image forming apparatus includes an abutting portion to abut against an abutted portion provided on the protecting cover in the insertion direction to regulate movement of the protecting cover in the insertion direction.

10. An electrophotographic image forming apparatus according to claim 7, wherein said engaging portion is provided on a downstream side of the positioning portion in the insertion direction.

11. An electrophotographic image forming apparatus according to claim 7, wherein said positioning portion and said engaging portion are provided above an opening, which is provided in said apparatus main body, and through which the process cartridge is inserted into said apparatus main body.

12. An electrophotographic image forming apparatus according to claim 7, wherein said positioning portion and said engaging portion are provided below an opening, which is provided in said apparatus main body, and through which the process cartridge is inserted into said apparatus main body.

* * * * *